US005974283A

United States Patent [19]

Cho

[11] Patent Number: 5,974,283

[45] Date of Patent: Oct. 26, 1999

[54] PAPER FEED DEVICE FOR DUPLEX PRINTING APPARATUS

[75] Inventor: Won-Mo Cho, Kyonggi-do, Rep. of Korea

[73] Assignee: SamSung Electronics Co., Ltd., Kyungki-do, Rep. of Korea

[21] Appl. No.: 09/196,256

[22] Filed: Nov. 27, 1998

[30] Foreign Application Priority Data

Nov. 27, 1997 [KR] Rep. of Korea ..... 97-63405

[51] Int. Cl.[6] ..... G03G 15/00

[52] U.S. Cl. ..... 399/75; 399/401; 271/301; 271/902

[58] Field of Search ..... 399/75, 401, 402; 271/301, 902

[56] References Cited

U.S. PATENT DOCUMENTS 4,835,567 5/1989 Ogata .
4,928,127 5/1990 Stemmle .
4,928,150 5/1990 Hatta .
5,055,885 10/1991 Yoshikado et al. .
5,081,508 1/1992 Kotani et al. .
5,448,348 9/1995 Azeta .

*Primary Examiner*—Joan Pendegrass
*Attorney, Agent, or Firm*—Robert E. Bushnell, Esq.

[57] ABSTRACT

A paper feed device for a duplex printing apparatus. The paper feed device includes a hinge link coupled to an end of a solenoid, an arm link extended upwards from the hinge link, a reverse guide coupled to the arm link by a guide hinge, a vertical link coupled to one side of the hinge link by a hinge, and a plurality of gears for changing the turning direction of rollers according to a print mode.

5 Claims, 3 Drawing Sheets

PAPER FEED DEVICE FOR DUPLEX PRINTING APPARATUS

CLAIM OF PRIORITY

This application makes reference to, incorporates the same herein, and claims all benefits accruing under 35 U.S.C. §119 from an application for PAPER FEED DEVICE FOR DUPLEX PRINTING APPARATUS earlier filed in the Korean Industrial Property Office on Nov. 27$^{th}$, 1997 and there duly assigned Serial No. 63405/1997.

BACKGROUND OF THE INVENTION

1. Field of the Invention

The present invention relates to a duplex printing apparatus, and more particularly, to a paper feed device for reversing a paper feed path for duplex printing.

2. Description of the Related Art

An existing type of duplex printing apparatus includes a main body and a duplex unit installed at one side of the main body. A first delivery roller and a first feed roller are respectively installed at the upper and lower sides of the duplex unit. A driving motor connected to drive the first delivery roller is installed at the inner side of the duplex unit. A solenoid is installed under the driving motor.

When the duplex unit is attached to the main body, the first delivery roller and the first feed roller respectively touch a second delivery roller and a second feed roller installed at corresponding portions of the main body, thereby forming one paper feed path. A central rod of the solenoid moves outward to push an upper portion of a reverse paper guide during simplex printing, and moves inward to release the reverse paper guide during duplex printing.

For simplex printing, a sheet picked up by the revolution of a pickup roller from a paper cassette is fed to a developing unit through a paper guide. An image is formed on one (front) side of the sheet while the sheet passes between a photoconductive drum of the developing unit and a fixing roller. The image is fixed on the sheet when the sheet passes between a heating roller and a pressure roller. Thereafter, the sheet passes through the upper side of a reverse paper guide. The sheet fed along a paper feed path is discharged to the exterior of the main body by the revolution of first and second exit rollers.

For duplex printing, the central rod of the solenoid is retracted. The sheet, printed on the front side, is fed between the delivery rollers through the lower side of the reverse paper guide. The sheet is sensed by a sensor and the delivery rollers are driven in reverse by the driving motor. Then the sheet is fed between the first and second feed rollers along a reverse paper feed path. The sheet is fed between third and fourth feed rollers and is again picked up by the pickup roller. Thereafter, the image forming process for the back side of the sheet is performed.

The duplex printing unit required for duplex printing has a driving motor for driving the delivery rollers and a solenoid for controlling the reverse paper guide. Since the duplex unit includes a driving motor and a number of rollers, its cost is high and its internal construction becomes complicated. Therefore, the duplex unit is not included with the main body of the duplex printing apparatus as standard equipment, but rather is installed as an accessory at one side of the main body as needed by the user.

Other examples of apparatus for duplex printing can be seen in the following U.S. patents. U.S. Pat. No. 4,835,567 to Ogata entitled Paper Re-Feeding Apparatus Of Image Forming Apparatus discusses duplex copying involving guiding the paper through a gate downward by a turn unit onto a stacker with other sheets, where the paper is picked up, sent through switchback rollers and guided by a gate to the developing and fixing units where the paper is printed on the other side. This apparatus has two motors, and requires the activation of several gates as well as stopping and reversal of two pairs of rollers to achieve duplex printing.

U.S. Pat. No. 4,928,127, to Stemmle, entitled Sheet Circulation in a Duplex Printer, discusses a duplex printing apparatus involving the use of reversible rollers. In this design, however, the reversing rollers also serve as discharge rollers, requiring that the duplex printed sheet be partially ejected on the discharge tray during duplex printing. This can cause problems due to interaction with sheet already lying in the discharge tray.

U.S. Pat. No. 4,928,150, to Hatta, entitled Copy Apparatus Having Plural Copy Sheet Discharge Trays for Different Sized Copy Sheets, describes a duplex copying machine which uses reversing rollers partially ejecting the sheet onto a discharge tray to redirect the sheet for the second-side printing. Again, there are potential problems with interactions with sheets on the discharge tray. A solenoid is required to activate the reversing rollers, and the mechanism of this activation is not disclosed.

U.S. Pat. No. 5,055,885, to Yoshikado, entitled Picture Image Forming Equipment, describes a duplex device and in particular the gate where the image-forming channel, paper-discharging channel and paper-reversing channel meet. This apparatus, however, requires a pair of reversing rollers and a lever as part of the gate mechanism, possibly adding to the complexity of the apparatus.

U.S. Pat. No. 5,081,508, to Kotani et al., entitled Paper-Jam Detecting Device, describes a duplex printing apparatus in which the reversing rollers discharge the paper onto the discharge tray. The patent deals with a device for detecting the paper jam caused when the paper is partially ejected and then reversed back for duplex printing, but in the process adheres to papers already in the tray. This device is thus an added layer of complexity to solve a problem created by a certain duplex printing arrangement.

U.S. Pat. No. 5,448,348, to Azeta, entitled Image Forming Apparatus Having A Sheet Material Transport Device, describes a duplex printing apparatus which during duplex printing partially discharges the paper onto the discharge tray before reversing. Again, this device suffers from the problems associated with partial discharge of the paper onto the discharge tray. Additionally, the reversal step requires reversing the motor and changing the position of a flapper.

Based on my observation of the art, I have decided that what is needed is a duplex printing apparatus where the duplex printing mechanism is of simple design and low cost, so that duplex printing can be incorporated cheaply as standard equipment. In particular, it is desirable to avoid reversing the main motor or to have an extra motor to achieve duplex printing.

SUMMARY OF THE INVENTION

It is therefore an object of the present invention to provide an improved duplex printing apparatus.

It is another object of the present invention to provide a paper feeding device which can be incorporated in a duplex printing apparatus.

It is yet another object to provide a paper feeding device for duplex printing which is of simple design.

It is still another object to provide a paper feeding device for duplex printing which does not require an additional driving motor.

It is a further object to provide a paper feeding device for duplex printing which requires only one solenoid for the duplex operation.

It is yet a further object to provide a paper feeding device which does not involve partially expelling the paper being printed onto the discharge tray.

It is a still further object to provide a paper feeding device which is of low cost.

To achieve these and other objects, the present invention provides a paper feed device for a duplex printing apparatus which includes a main gear turning by a main motor; a first coupling gear engaged with the main gear; an exit roller gear engaged with the first coupling gear and coupled to an axle of an exit roller; a hinge gear engaged with the first coupling gear; a link gear engaged with the hinge gear; a coupling link having both ends coupled to the hinge gear and the link gear and turning round an axle of the hinge gear; a reverse feed gear installed under the coupling link; a reversing, or delivery, roller gear engaged with the reverse feed gear and coupled to an axle of a reversing, or delivery, roller; a forward feed gear (or second coupling gear) engaged with the reversing roller gear; an idle gear engaged with the forward feed gear and installed over the link gear; a hinge link having one end coupled by a link hinge to one side of a main body and having the other end coupled to an end of a solenoid; an arm link extended upwards from one side of the hinge link; a reverse paper guide having a middle part coupled to the upper side of the arm link by a guide hinge; and a vertical link having one end coupled to the center of the hinge link by a hinge and having the other end coupled by a hinge to the coupling link positioned toward the link gear.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
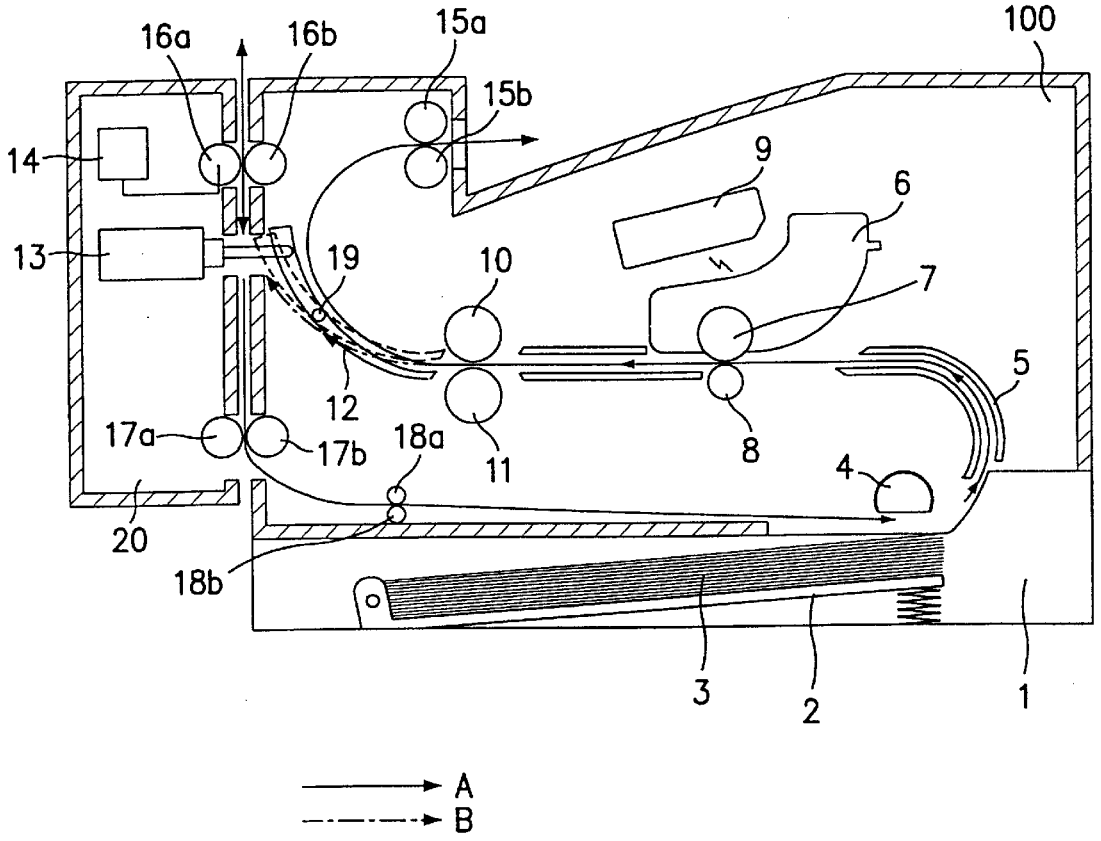
FIG. 1 (Related Art)
FIG. 1 is an elevational diagram schematically showing the internal construction of an existing duplex printing apparatus.

FIG. 1 schematically shows the internal construction of an existing duplex printing apparatus. The duplex printing apparatus includes main body 100 and duplex unit 20 installed at one side of main body 100. First reversing, or delivery, roller 16*a* and first feed roller 17*a* are respectively installed at the upper and lower sides of duplex unit 20. Driving motor 14 connected to drive first reversing roller 16*a* is installed at the inner side of duplex unit 20. Solenoid 13 is installed under driving motor 14.

When auxiliary duplex unit 20 is attached to main body 100, first reversing roller 16*a* and first feed roller 17*a* respectively touch second reversing, or delivery, roller 16*b* and second feed roller 17*b* installed at corresponding portions of main body 100, thereby forming one paper feed path. A central rod of solenoid 13 moves outward to push an upper portion of reverse paper guide 12 during simplex printing, and moves inward to release reverse paper guide 12 during duplex printing.

An image forming process of the duplex printing apparatus having such a duplex unit will now be described with reference to FIG. 1. For simplex printing, sheet 3 picked up by the revolution of pickup roller 4 from paper cassette 1 is fed to developing unit 6 through paper guide 5. An image is formed on one (front) side of the sheet while the sheet passes between photoconductive drum 7 of developing unit 6 and fixing roller 8. The image is fixed on the sheet when the sheet passes between heating roller 10 and pressure roller 11. Thereafter, the sheet passes through the upper side of reverse paper guide 12. The sheet, fed along paper feed path "A", is discharged to the exterior of main body 100 by the revolution of first and second exit rollers 15*a* and 15*b*.

For duplex printing, the central rod of solenoid 13 is retracted, moving into solenoid 13. The sheet, on the front side of which the image was formed while passing between heating roller 10 and the pressure roller 11, is fed between reversing rollers 16*a* and 16*b* through the lower side of reverse paper guide 12. The sheet is sensed by a sensor (not shown) and reversing rollers 16*a* and 16*b* are rotated reversely by driving motor 14. Then the sheet is fed between the first and second feed rollers 17*a* and 17*b* along reverse paper feed path "B". The sheet is fed between third and fourth feed rollers 18*a* and 18*b* and again picked up by pickup roller 4. Thereafter, the image forming process for the back side of the sheet is performed.

For duplex printing, the above-described duplex printing apparatus includes duplex unit 20 having driving motor 14 for driving the reversing rollers 16*a* and 16*b* and solenoid 13 for controlling reverse paper guide 12. Since duplex unit 20 includes driving motor 14 and a plurality of rollers 16*a* and 17*a,* its cost is high and its internal construction becomes complicated. Therefore, the duplex unit is not included as part of the main body of the duplex printing apparatus as standard equipment, but is installed as an accessory at one side of the main body according to a demand from the user.

Figure 2:
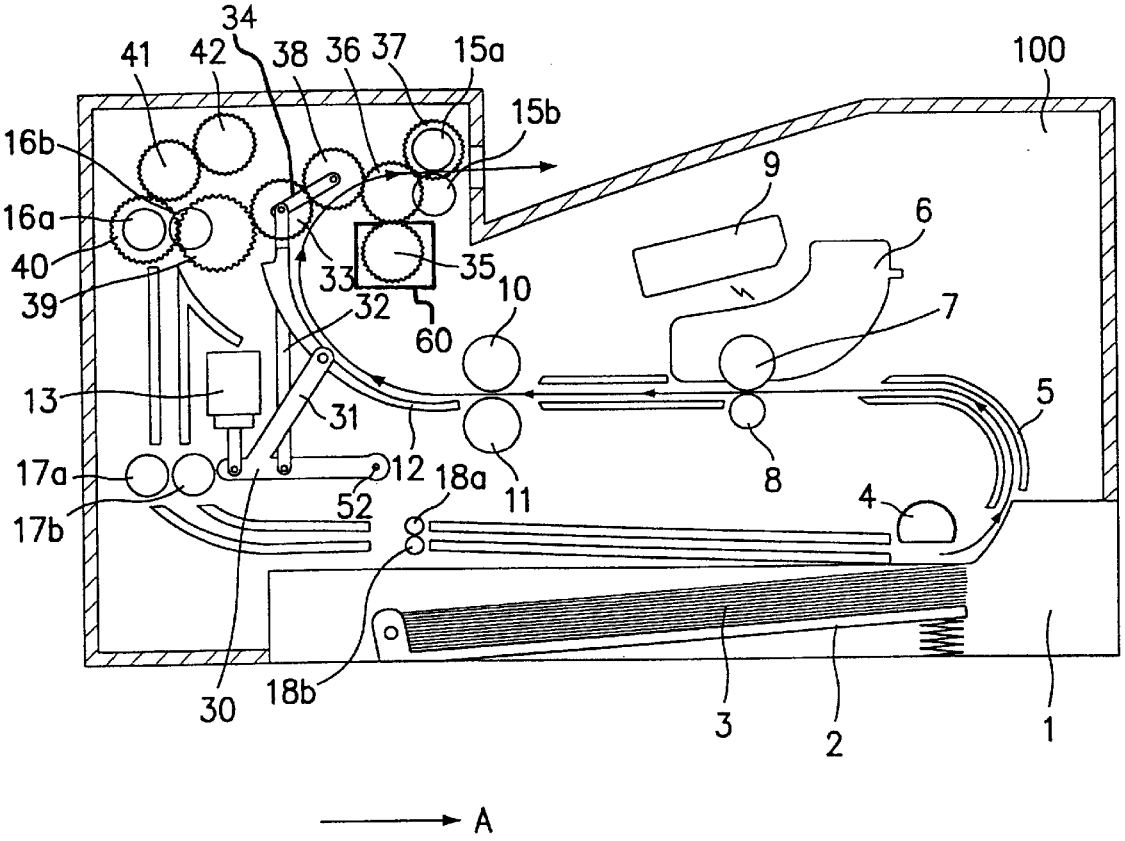
FIG. 2 is an elevational diagram showing the simplex printing operation of a paper feed device of a duplex printing apparatus according to the present invention.
Figure 3:
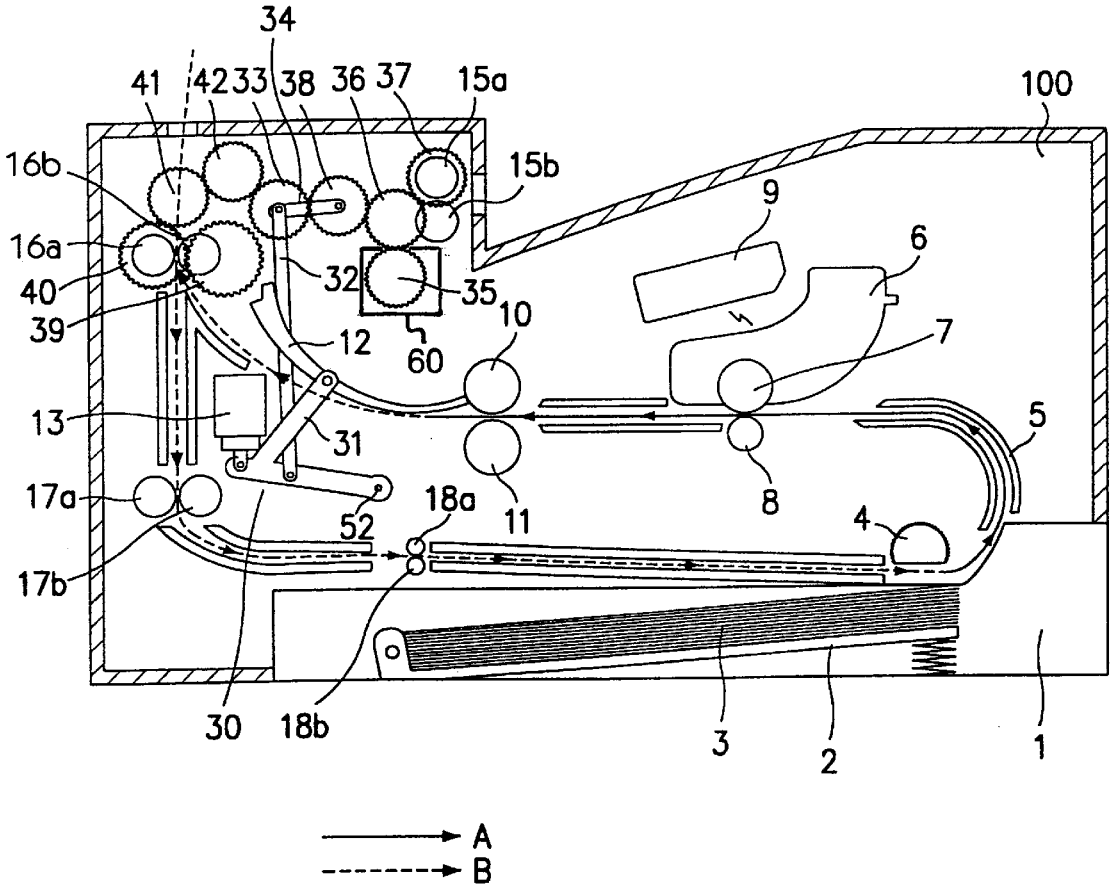
FIG. 3 is an elevational diagram showing the duplex printing operation of a paper feed device of a duplex printing apparatus according to the present invention.

A paper feed device for a duplex printing apparatus according to the present invention is shown in FIGS. 2 and 3. This device includes main gear 35 coupled to main motor 60, first coupling gear 36 engaged with main gear 35, exit roller gear 37 engaged with first coupling gear 36 and coupled to an axle of first exit roller 15*a,* hinge gear 38 engaged with first coupling gear 36, and link gear 33 engaged with hinge gear 38.

Coupling link 34 has one end coupled to hinge gear 38 and another end coupled to link gear 33, and turns around hinge gear 38. Reverse feed gear 39 is installed lower than coupling link 34, such that link gear 33 engages reverse feed gear 39 when in the position shown in FIG. 2. Reversing roller gear 40 engaged with reverse feed gear 39 is coupled to an axle of first reversing roller 16*a*. Forward feed (or second coupling) gear 41 engages with reversing roller gear 40. Idle gear 42 engaged with forward feed gear 41 is installed over link gear 33, such that link gear 33 engages idle gear 42 when in the position shown in FIG. 3.

Hinge link 30 has one end coupled by link hinge 52 and another end coupled to a piston rod of solenoid 13. Arm link 31 is extended upwards from the center of hinge link 30. Reverse paper guide 12 has a middle part coupled to the upper side of arm link 31 by a guide hinge. Vertical link 32 has one end coupled to the center of hinge link 30 by a hinge and another end coupled by a hinge to coupling link 34 at a position toward link gear 33.

For simplex printing, sheet 3 is picked up by the revolution of pickup roller 4 from atop paper plate 2 in paper cassette 1 and is fed to developing unit 6 through paper guide 5, as shown in FIG. 2. The sheet, on the front side of which the image was formed while passing between photoconductive drum 7 of developing unit 6 and fixing roller 8 which is connected to exposing unit 9, passes between heating roller 10 and pressure roller 11. The sheet is fed along paper feed path "A" through the upper side of reverse paper guide 12.

Main gear 35 coupled to main motor 60 turns counterclockwise and first coupling gear 37 also turns counterclockwise. Therefore, first exit roller 15*a* turns counterclockwise. The sheet fed along the paper feed path "A" is discharged to the exterior of main body 100 of the duplexing printing apparatus by first and second exit rollers 15*a* and 15*b*.

For duplex printing, if a duplex print mode is selected through an external operating switch, sheet 3 picked up by the revolution of pickup roller 4 from paper cassette 1 is fed to developing unit 6 through paper guide 5, as shown in FIG. 3. The sheet, on the front side of which the image was formed while passing between photoconductive drum 7 of developing unit 6 and fixing roller 8, is fed between heating roller 10 and pressure roller 11.

When a voltage is applied to solenoid 13 by a controller (not shown), the central rod of solenoid 13 moves up and hinge link 30 having one end coupled to the central rod of solenoid 13 turns upwards around link hinge 52. Arm link 31 extended from hinge link 30 also turns and the upper side of reverse paper guide 12 coupled to arm link 31 by the hinge comes down. Vertical link 32 having one end coupled to hinge link 30 moves upwards and link gear 33 which was engaged with reverse feed gear 39 interlocks with idle gear 42. That is, link gear 33 coupled to the hinge gear 38 by coupling link 34 turns upwards around the axle of hinge gear 38 and engages with idle gear 42.

The sheet which has passed between heating roller 10 and pressure roller 11 is then fed between first and second reversing rollers 16*a* and 16*b* through the lower side of reverse paper guide 12 along reverse paper feed path "B". Just before the sheet passes out from between reversing rollers 16*a* and 16*b*, a sensor (not shown) senses the sheet. If sensing information from the sensor is transmitted to the controller, the controller cuts off the voltage applied to solenoid 13. Then the central rod of solenoid 13 moves outward and hinge link 30 and arm link 31 return to their respective positions for the simplex printing. Vertical link 32 moves downwards, and link gear 33 engages with reverse feed gear 39. Reversing roller gear 40 turns clockwise and first reversing roller 16*a* also turns clockwise.

The sheet between the reversing rollers 16*a* and 16*b* now moves downwards along reverse paper feed path "B", and passes between first and second feed rollers 17*a* and 17*b* and between third and fourth feed rollers 18*a* and 18*b*. The sheet is again fed to developing unit 6. An image is then formed on the back side of the sheet and the sheet is then discharged to the exterior of main body 100 of the duplex printing apparatus along the paper feed path "A".

As described above, the paper feed device allows the duplex printing process of a sheet using the main motor and a solenoid, without an additional driving motor. Therefore, the manufacturing cost of the duplex printing apparatus can be reduced.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A paper feeding apparatus for duplex printing, comprising:

a main motor;

a main gear driven by said main motor;

a first coupling gear engaged with said main gear;

an exit roller gear engaged with said first coupling gear;

an exit roller coaxially driven by said exit roller gear;

a hinge gear engaged with said first coupling gear;

a coupling link having a first end and a second end, said first end of said coupling link pivotally attached to an axis of said hinge gear;

a link gear having an axis, said axis of said link gear pivotally attached to said second end of said coupling link, such that said link gear is engaged with said hinge gear;

a vertical link having an upper end and a lower end, said upper end of said vertical link pivotally attached to said axis of said link gear;

a link hinge mounted in the printer;

a hinge link having a first end, a second end and a middle, said first end of said hinge link pivotally attached to said link hinge, said middle of said hinge link pivotally attached to said lower end of said vertical link;

a solenoid having a piston rod, said piston rod pivotally attached to said second end of said hinge link;

an arm link extending upward from said middle of said hinge link, said arm link having an upper side;

a reverse paper guide having a curved shape, a middle part of said reverse paper guide being pivotally attached to said upper side of said arm link;

an idle gear, mounted so as to engage said link gear when said piston rod is retracted in said solenoid;

a forward feed gear engaged with said idle gear;

a reversing roller gear engaged with said forward feed gear;

a first reversing roller coaxially attached to said reversing roller gear so as to be driven by said reversing roller gear;

a second reversing roller engaged with said first reversing roller; and a reverse feed gear engaged with said reversing roller gear, said reverse feed gear mounted so as to engage said link gear when said piston rod is extended in said solenoid.

2. The apparatus of claim 1, further comprising:

a fixing unit located so as to feed paper toward a lower portion of said reverse paper guide; and a developing unit located so as to feed paper to said fixing unit.

3. The apparatus of claim 2, further comprising:

a sensor for detecting when a paper has almost passed between said first and second reversing rollers;

means of controlling said solenoid based on the detection of the paper;

means for routing a paper moving down from said first and second reversing rollers so that the paper then moves under said fixing unit and said developing unit and then into said developing unit.

4. A method of performing duplex printing, comprising the steps of:

activating a solenoid which is mechanically linked to both a reverse paper guide and to a link gear such that said reverse paper guide is raised and said link gear is engaged in a gear train from a main motor to drive a pair of reversing rollers in a forward direction;

printing a paper on one side in a printing unit;

feeding said one-side printed paper to an underside of said reverse paper guide, thereby guiding it into said pair of reversing rollers;

detecting when said one-side printed paper is almost through said pair of reversing rollers, then deactivating said solenoid to lower said reverse paper guide and to engage said link gear in a gear train from said main motor to drive said pair of reversing rollers in the reverse direction;

guiding said one-side printed paper underneath said printing unit and then into said printing unit;

printing said paper to give a two-side printed paper;

feeding said two-side printed paper to a top side of said reverse paper guide, thereby guiding said two-side printed paper to be discharged from the printer.

5. The method of claim 4, where the steps of printing the paper comprise use of a developing unit and a fixing unit.

* * * * *